US005199499A

United States Patent [19]

Butler

[11] Patent Number: 5,199,499

[45] Date of Patent: Apr. 6, 1993

[54] OIL WELL FIRE CAPPER/SNUFFER

[75] Inventor: Barry L. Butler, Solana Beach, Calif.

[73] Assignee: Science Applications International Corporation, San Diego, Calif.

[21] Appl. No.: 769,903

[22] Filed: Oct. 1, 1991

[51] Int. Cl.[5] ..... A62C 3/06

[52] U.S. Cl. ..... 169/46; 166/312; 169/52; 169/69

[58] Field of Search ..... 169/69, 43, 46, 52; 166/95, 277, 312

[56] References Cited

U.S. PATENT DOCUMENTS 1,918,161 7/1933 Whitwam ..... 169/69 X
4,336,843 6/1982 Petty ..... 169/69 X

OTHER PUBLICATIONS

"Kuwaiti Well Control Campaign Progressing" *Oil and Gas Journal,* May 13, 1991, pp. 34 and 35.

"What's Happening in Drilling", *World Oil,* Sep. 1991, p. 25.

"Capping Blowouts from Iran's Eight Year War", *World Oil,* May 1991, pp. 44-48.

"Fired-Up Inventors Have a Plan", *Los Angeles Times,* Business Section, p. 1, col. 2, Jul. 13, 1991.

*Primary Examiner*—Charles A. Marmor
*Assistant Examiner*—Andrew C. Pike
*Attorney, Agent, or Firm*—Fitch, Even, Tabin & Flannery

[57] ABSTRACT

Apparatus and method for extinguishing oil well fires by plugging a wellhead pipe from which oil, gas and a fire flame front are emanating including centering and fluid ballasting a capper over the wellhead pipe, forcibly inserting the capper into the wellhead pipe to seal the wellhead pipe and introducing mud through the capper into the wellhead pipe to "kill" the fire. The apparatus includes the capper, fluid ballast and pressure exerting apparatus and plugging apparatus.

30 Claims, 6 Drawing Sheets

OIL WELL FIRE CAPPER/SNUFFER

FIELD OF THE INVENTION

The present invention is generally directed to the field of oil well technology and specifically to a method and apparatus for stopping the flow of oil and gas from damaged oil wellheads and extinguishing the fires therefrom.

BACKGROUND OF THE INVENTION

Damaged oil wells releasing uncontrolled flows of geopressured oil and gas represent a significant loss of revenue as well as a fire and environmental hazard. The key to controlling the flow from a damaged oil well which is on fire is to divert, or at least tolerate, the flame front emanating from the wellhead while effectively corking the wellhead and stopping the subsequent flow of oil and gas therefrom, thus "snuffing" or "killing" the fire by removing its source of fuel.

In many cases, such as in the oil fields in Kuwait, there is either strong geologic overpressure at the wellhead and/or a substantial dynamic gas pressure which causes the oil to "gush" from the well, sometimes with considerable force. For a typical 3.5-inch diameter production well pipe, this upward-driving force may reach as much as 70,000 lb., or even higher. As a result, the "cork" must be strongly anchored and, frequently, be quite heavy.

To be effective, a well capper and fire "snuffer" should perform the following five separate functions: (1) divert the flame front or tolerate it if fire is present; (2) find the bent and twisted wellhead pipe opening; (3) exert a downward capping force greater than that of the upward geologic and gas pressure forces so as to penetrate the pipe and halt the oil and gas flow; (4) seal the wellhead pipe against leakage; and (5) allow mud to be pumped into the well pipe until the well pressure equals or balances the geopressure or earth's own pressure thus "killing" the well for subsequent repair and maintenance. Once flow control repair work is completed, simply removing the mud will allow production to be resumed safely.

Prior art practices for capping an out of control oil well require extinguishing the fires by removing the combusting air from the escaping fuel. In one method this is accomplished by detonating explosives placed to create a shock wave and oxygen starved air which act to remove oxygen from around the fire. Another method involves injecting liquid nitrogen into and around the the oil/gas stream from the wellhead using a "stove pipe", to accomplish the same result. Since neither approach stops the flow of oil and gas from the wellhead, it is most important that the ground surrounding the burning well be thoroughly cooled with water and that any hot debris or wreckage be removed to prevent the spontaneous reignition of the gushing oil and gas. At least 100,000–1,000,000 gallons of water per well site is typically required to accomplish such cooling, and the water, generally speaking, cannot be recovered. In a desert area, such as the Arabian peninsula and in a number of other Middle Eastern oil fields, reliably providing such amounts of water can often be a significant problem.

Once the fire is extinguished, a packer or "capper" is placed in the well bore and secured by clamping the packer to a flange on the wellhead pipe. Due to the high well pressures and the highly combustible nature of the oil and gas mixture flowing from the wellhead pipe, such capping of the freely flowing oil and gas stream is quite hazardous and requires highly skilled personnel to accomplish. One inadvertent spark can rekindle the fire of the flow stream and oil pooled on the ground surrounding the well. Furthermore, as in the Kuwait oil field, the wellhead pipes and connecting flanges are often destroyed making the well capping by a conventional packer nearly impossible.

Finally, drilling mud is pumped into the well to fill the well pipe and shut off the oil and gas flow therefrom. The packer can then be removed and repairs made on the non-flowing well. Alternatively, the necessary repairs may be made on the pressurized well capped by the packer.

Thus, there is a need for (1) improved oil well capping and fire snuffing apparatus which is free standing and does not require attachment or clamping to a damaged or missing wellhead pipe and (2) improved and simplified methods for more quickly, safely and inexpensively extinguishing oil well fires while using much less water and being able to recover and reuse the water. The present invention satisfies such needs.

SUMMARY OF THE INVENTION

The present invention comprises a low cost method and apparatus for accomplishing both the simultaneous extinguishing or snuffing of oil well fires and the capping of the well for subsequent repairs with minimum risk to both personnel and equipment and with maximum recovery of water or fluid used therein.

In a first embodiment, the apparatus of the present invention comprises (1) a sealing skirt and diverter which when placed on the wellhead causes the upwardly directed flame front to be directed to the sides away from the wellhead, (2) at least one fluid (water or other fluid or denser slurry like "mud")-containing ballast tank, (3) a capper which penetrates the wellhead and (4) means for supplying a sufficient amount of mud into and through the capper to both shut off the oil and gas flow and extinguish the fire. The pumpable fluid in the ballast tank, which is recoverable, is used to provide the weight necessary to overcome the upward geopressure. The ballast provides the reaction force necessary to insert the capper "cork" into the well to extinguish the fire and shut off the oil and gas flow. In a second embodiment, the capper is mounted on a rotatable yoke and a hydraulic ram is used to force the capper into the wellhead. The rotatable yoke is attached to ground level ballast tanks next to the well.

The method of the present invention comprises the steps of centering the capper over the well pipe, fluid ballasting the capper to overcome well pressure, inserting the capper into the wellhead pipe from which the flame front is emanating and pumping a sufficient amount of mud into the wellhead to shut off the oil and gas flow therefrom.

BRIEF DESCRIPTION OF THE DRAWINGS

The various features and advantages of the apparatus and method of the present invention may be more readily understood with reference to the following detailed description taken in conjunction with the accompanying drawings, wherein like reference numerals and letters designate like structural elements and features, and in which.

DETAILED DESCRIPTION OF THE INVENTION

Figure 1A:
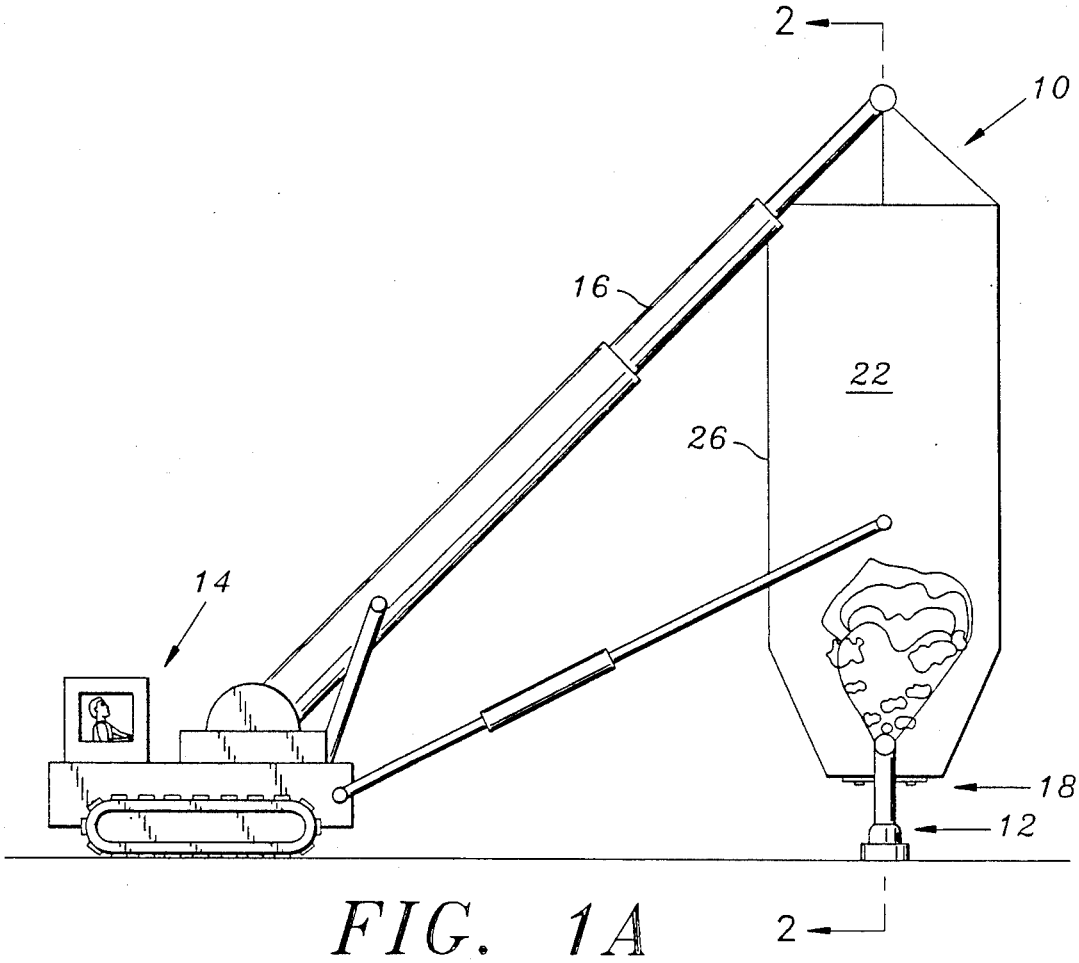
FIGS. 1A and B are schematic side and top view representations, respectively of the major components of a gravity feed embodiment of the apparatus of the present invention.
Figure 1B:
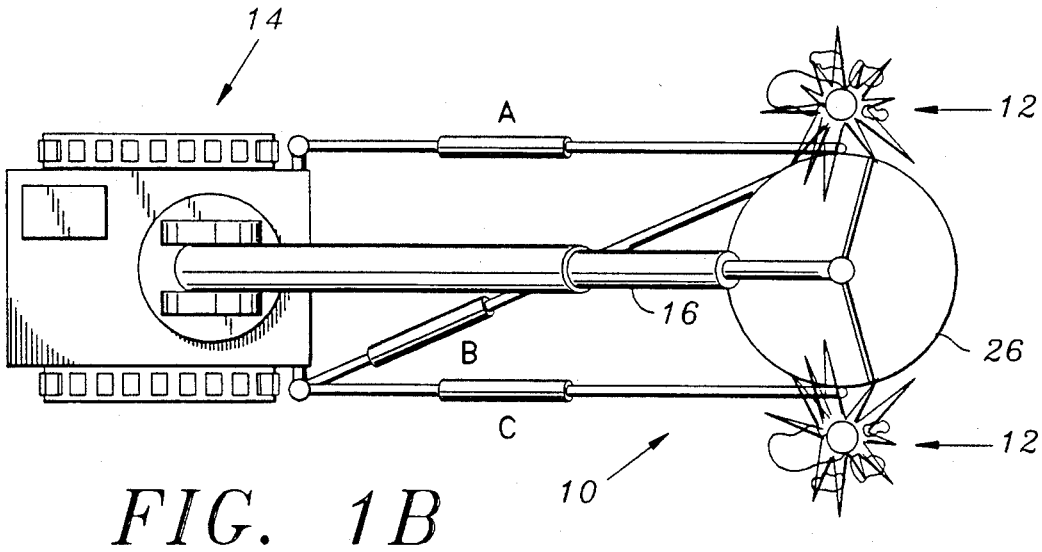

FIGS. 1A and B schematically depict a first embodiment of the capper/snuffer apparatus 10 of the present invention, the gravity feed system. As shown, the apparatus 10 is adapted to be positioned over a flaming wellhead 12 by a standard boom crane 14 which has been modified to be fire resistant. The top of apparatus 10 comprising a fluid ballast tank with only a small amount of fluid to keep the tank cool is supported by cables in an upright position at the end of a crane arm 16 and positioned both longitudinally and laterally by a plurality of side supports designated A, B and C.

Generally speaking, in addition to mobile means defined by the boom crane 14, the apparatus 10 comprises capper means 18 for entering and sealing a wellhead pipe 20, pressure exerting means 22 (fluid ballast tank) for driving the capper means into the wellhead pipe, and plugging means 24 for stopping oil and gas flow from the wellhead and extinguishing the well fire.

Figure 2:
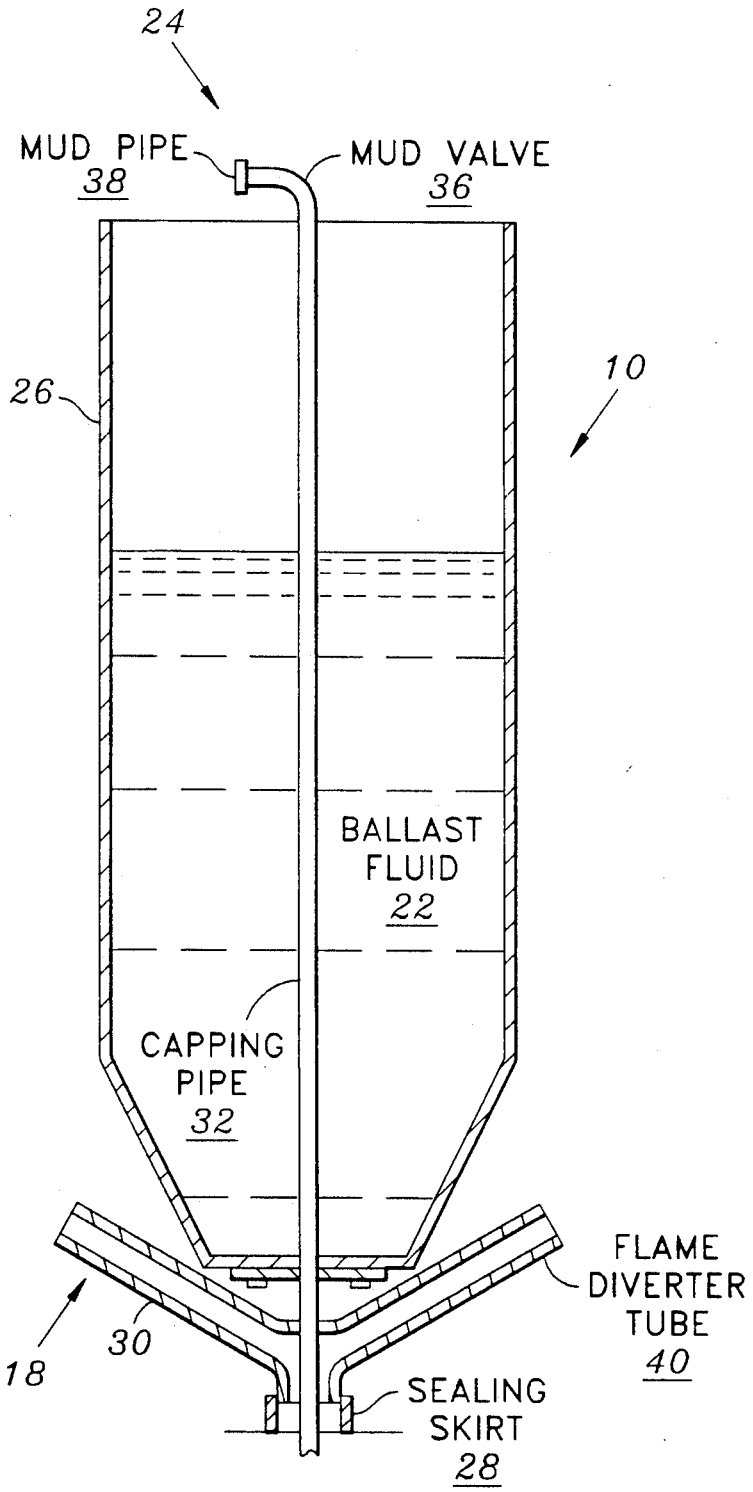
FIG. 2 is a sectional side view schematic of a water tank and a snuffer/capper along lines 2—2 as shown in FIG. 1A comprising a sealing skirt and flame diverter as used in the present invention.

More particularly, as shown in FIG. 2, in the first embodiment of the apparatus 10, a generally cylindrical ballast tank 26 comprises the pressure exerting means 22 and carries the capper means 18 and plugging means 24. An annular sealing skirt 28, flame diverter 30, capping pipe 32 and probe 34 comprise the capper means while a mud valve 36 and mud pipe 38 comprise means for supplying mud to the wellhead pipe to plug the well and "kill" the fire emanating therefrom. The skirt and diverter can slide along the capping pipe 32 and are positioned and supported directly below the tank 26.

The skirt 28 is adapted to axially receive and surround the wellhead pipe 20 from which a flame front is emanating. The diverter 30 includes a hollow base extending vertically from the skirt 28 with flame diverting tubes 40 open to the base and extending outwardly therefrom.

Figure 3A:
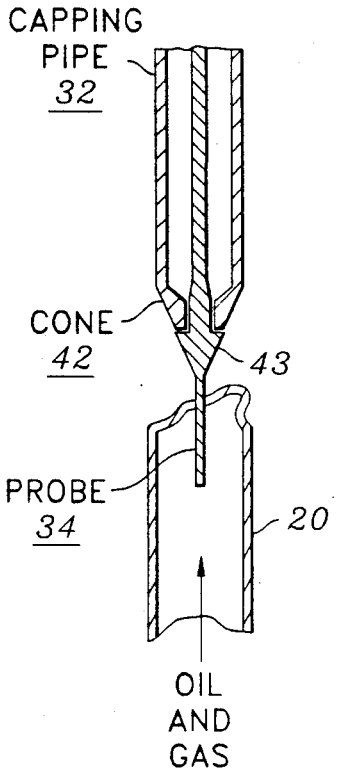
FIGS. 3A, B and C are schematic sectional representations of the insertion, sealing and mud pumping functions, respectively, of a snuffer/capper as used in the present invention (Note that a mud valve 43 is pictured. Flowing mud through the bottom of the capper is also acceptable)
Figure 3B:
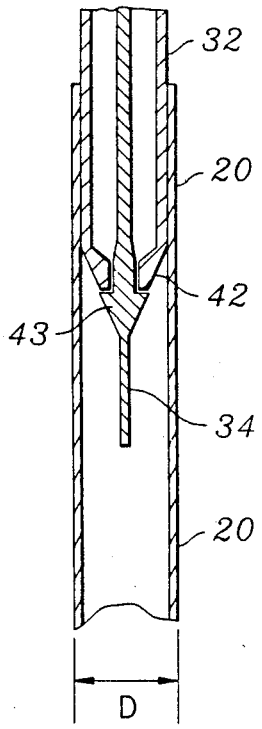

The capping pipe 32 is supported to extend axially through water tank 26 and sealing skirt 28. The capping pipe is closed at its upper-most end by the mud valve 36 connected to the mud pipe 38. As shown in more detail in FIGS. 3A, B and C, the bottom end of the capping pipe 32 comprises a hollow cone 42 which at its distal end is conical in shape for easy insertion into the open end of a wellhead pipe 20 from which a flame fuel emanates. As further shown, the capping pipe 32 contains the probe 34 which is axially moveable in the pipe and carries a valve 43 which may be spring biased to normally and effectively seal the open end of cone 42. Valve 43 may not be needed if mud is pumped continuously through the capping pipe to cool it.

Typically, flaming gas and oil exits in an upward direction from a damaged well through the wellhead pipe 20. This stream mixes with air and burns quite vigorously. To prevent damage to the capper means 18, it must be quickly positioned above the wellhead 12 by the crane 14 and centered over the wellhead pipe 20. Such placement may be facilitated by equipping the probe 34 with one or more sensors, such as pulse-echo ultrasonic detectors or thermal transducers, which emit signals and receive echo signals which may be displayed on a monitor in the cab of the crane 14. When the displayed echo signals are symmetrical, the probe 34 is centered in the oil and gas flow from wellhead pipe 20. To achieve such symmetry, the crane 14 is adapted by conventional position control means to allow the operator to manipulate the probe 34 by moving it forward or backward and/or from side-to-side with either the crane arm 16 or with small hydraulic positioners (not shown) in side supports A, B and C. Remote imaging x-ray and optical systems may also be used for such positioning control. X-ray source and imager placed on either side of the oil stream would allow the oil/gas stream to be looked through to tell where the probe is sitting with respect to the well pipe. Two x-ray source/imager could be place on axes 30° to 90° apart and allow 3 dimensional imaging of probe and well pipe locations. Laser beams between 30° to 90° apart observed by video cameras 30° to 90° apart along with the video image are a preferred option. In this regard, crossed piano wire cross hairs observed by video have been successful.

Before the capper means 18 comprising the cone 42 and probe 34 can be inserted into wellhead pipe 20, under the influence of the fluid ballast pressure exerting means 22, the pipe must be open wide enough to receive the probe and cone and not have any extraneous metal or other obstructions surrounding or inside it. Where deformed pipe situations occur there are a number of well known techniques, such as those developed by Red Adair, which can be used to correct the situation. For example, cut off saws can be used to sever pipes and trim metal, while their operators are water cooled. It is also necessary that any debris which would prevent the sealing skirt 28 from seating on the ground and flame diverter 30 from making effective contact with wellhead pipe 20 be removed prior to lowering fluid ballast tank 26.

Once the wellhead pipe 20 is cleared and probe 34 is placed over the wellhead pipe 20, tank 26 is filled with fluid ballast, usually water. Usually a capping force in the range of about 70,000 to about 300,000 lbs (for a 3.5 to 7.5 inch diameter well pipe) must be exerted to balance the upward forces of the gas and oil flowing from the well pipe 20 in response to the geopressures within the well. At 64 lb/ft$^3$, this will require between about 1100 and 4700 ft$^3$ of water. To supply the water to the tank 26, auxiliary water trucks are normally used as the source of supply. Generally, a 50 HP pump capable of pumping 1000 gallons/minute at a 30 ft head will be adequate to fill water tank 26 in a matter of a few minutes.

As the tank 26 fills with fluid, the weight of the ballast tank increases, and the whole of apparatus 10 is lowered with the crane 14 guiding it until the sealing skirt 28 and flame diverter 30 are positioned around the wellhead pipe 20. As the probe 34 enters the open end of wellhead pipe 20, the flame diverter 30 moves down until the sealing skirt 28 contacts the ground surrounding wellhead pipe 20. The sealing skirt 28 limits the amount of air that mixes with the exiting oil/gas stream while the flame diverter 30 symmetrically splits and divides the oil/gas stream to create a minimum of lateral force with burning taking place at the outlets of the tubes 40. This results in the flame being diverted away from the tank 26 as the cone 42 of capping tube 32 and probe 34 are forcibly inserted into the wellhead pipe 20 under the weight of the fluid in tank 26.

Without cooling, the probe 34 and capping pipe 32 can only tolerate heat and flame from the wellhead pipe for a short time. However, in the first embodiment, water in the tank 26 surrounds the capping pipe 32 and effects a cooling of the probe while it is inserted into the end of wellhead pipe 20.

To assure a good seal between the capping pipe and wellhead, one or more O ring grooves (not shown) are machined into the outer wall of capping pipe 32 adjacent the cone 42. Such grooves are adapted to receive a graphite rope or other suitable packing and the combination is sized to provide a close fit with the inside wall of wellhead pipe 20 to prevent oil and gas leakage.

Figure 3C:
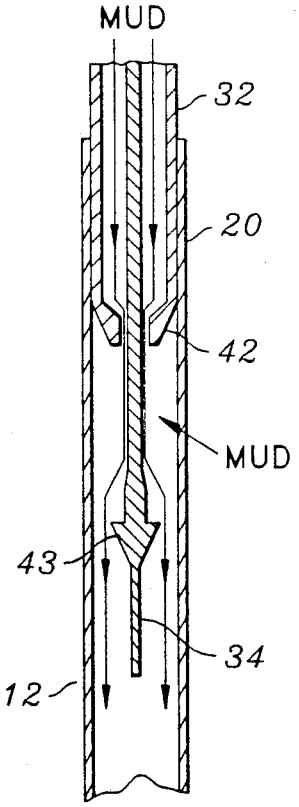

Once the probe 34 is seated within wellhead pipe 20, mud valve 36 is opened. As shown in FIG. 3C, a stream of mud then flows from a high pressure mud source through the mud pipe 38, mud valve 36 and capping pipe 32 to force the valve 43 and probe 34 away from the cone 42 of capping pipe. This allows a sufficient amount of mud to enter and seal off the wellhead 12 and stop the flow of oil and gas flow therefrom. Once the well is capped and plugged the fluid in tank 26 can be recovered and reused for yet another capping/snuffing application.

Figure 4:
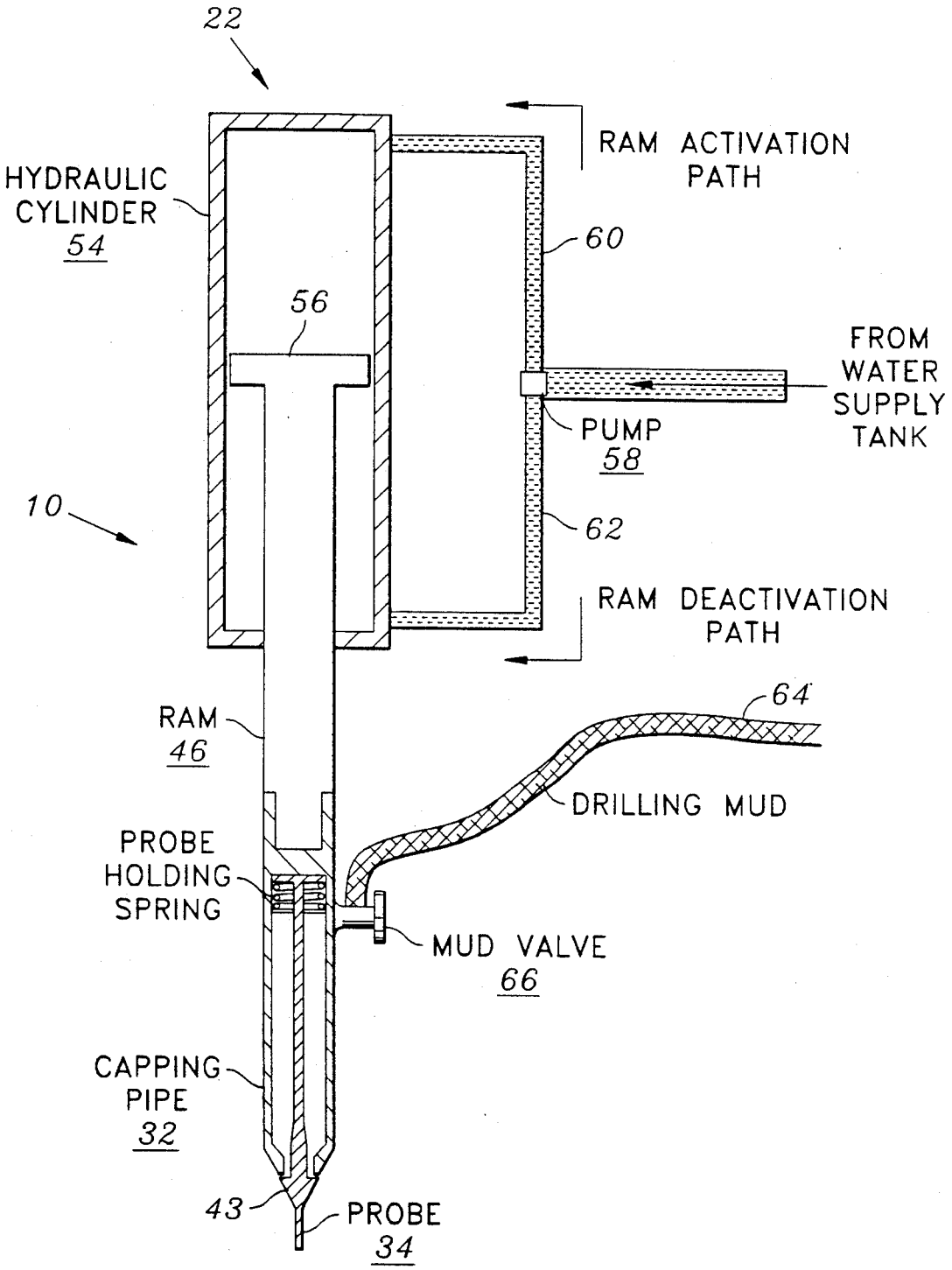
FIG. 4 is a schematic side view representation of a hydraulic ram embodiment of the apparatus of the present invention.
Figure 5A:
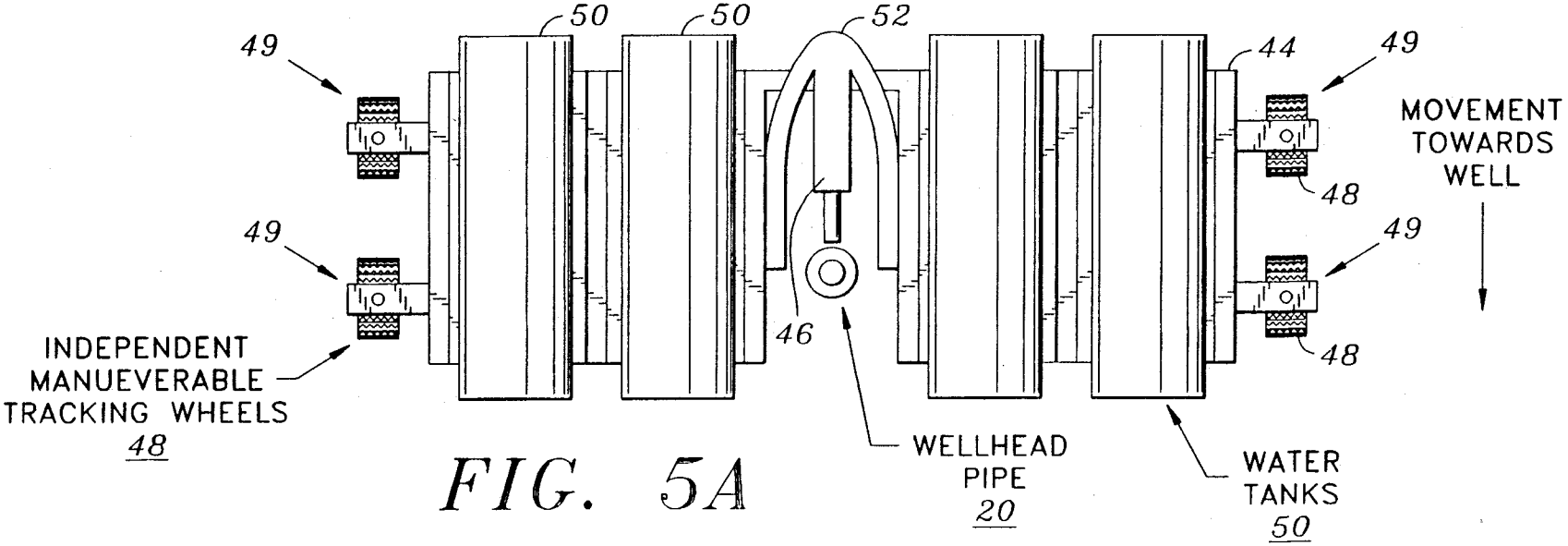
FIGS. 5A and B are schematic top and front views, respectively, of the ram system of FIG. 4 as used in the present invention, prior to actuation.
Figure 5B:
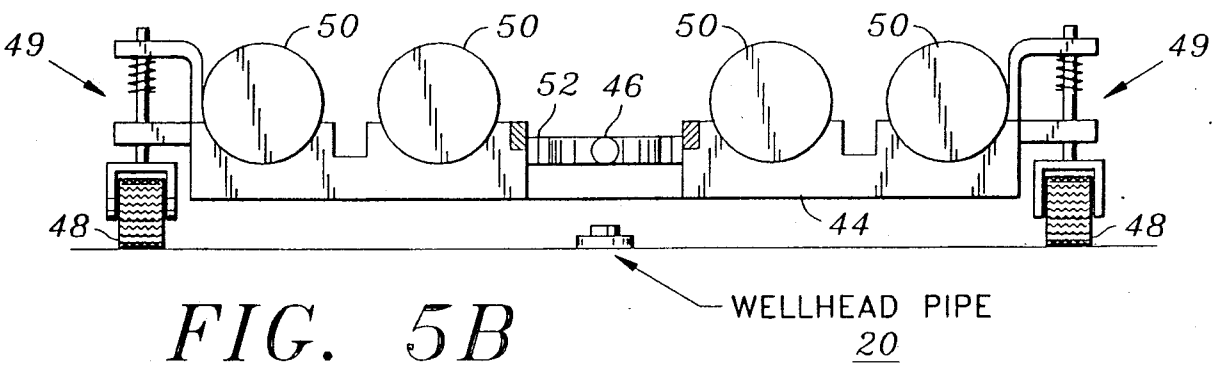
Figure 6A:
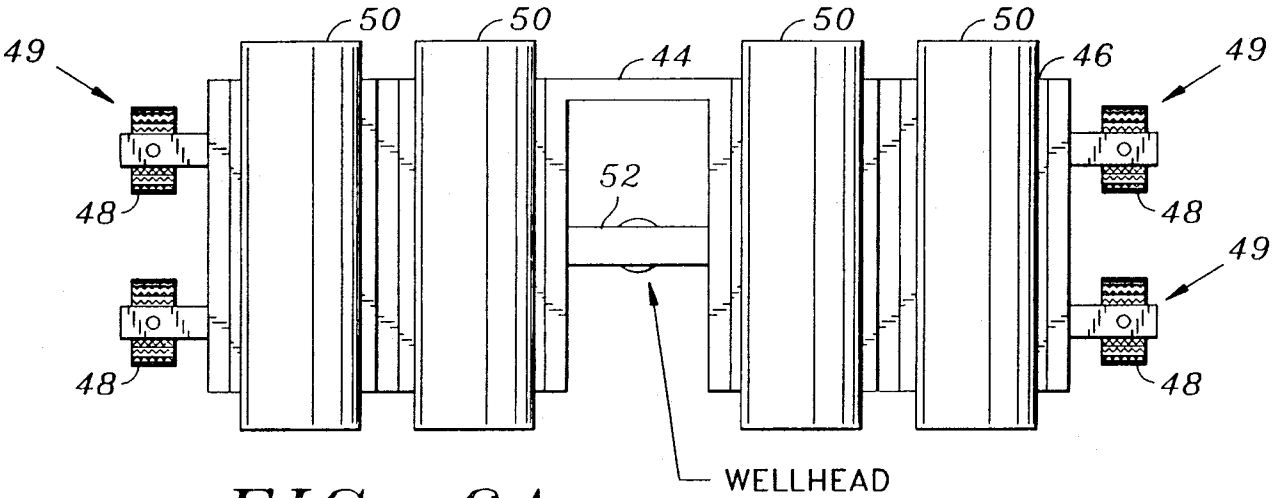
FIGS. 6A and B are schematic top and front views, respectively, of the ram system of FIG. 4 after actuation.
Figure 6B:
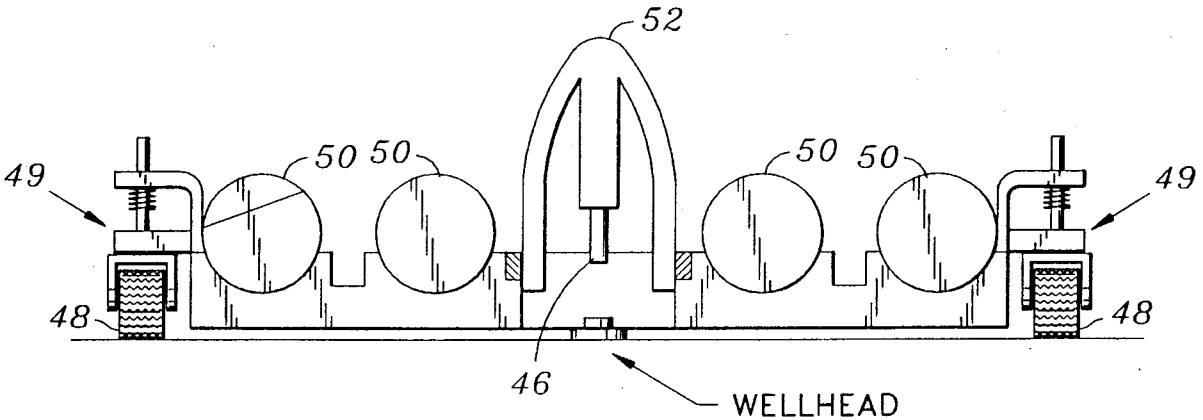

In a second embodiment of the present invention, shown in FIGS. 4, 5A, 5B, 6A and 6B, the mobile means defined by the crane 14 and tank 26 are replaced by a mobile ballast cart 44 with multiple ballast fluid tanks 50. The sealing skirt 28 and flame diverter 30 are replaced by a hydraulic ram system 46. As generally depicted in FIG. 5B, the cart 44 is supported for movement by flameproof tracking wheels/tractors 48 supported by compressible springs assemblies 49. Ballasting for the cart is provided by at least one, and usually a plurality of large fluid filled tanks 50. The hydraulic ram 46 is secured to and carried by a rotatable U-shaped yoke 52. The yoke 52, in turn is mounted on the frame of the cart 44 to move between a horizontal position as shown in FIGS. 5A and 5B with the ram 46 in the plane of the yoke and a vertical position as shown in FIGS. 6A and 6B with the ram over the wellhead 12.

As shown in FIG. 4, the ram 46 comprises a cylinder 54 and a piston 56 moveable axially in the cylinder in response to a fluid selectively pumped to and from opposite ends of the cylinder. In this regard, water from a supply tank may be directed to a pump 58 and selectively to and from the cylinder via outlet pipes 60 and 62 between the pump and the cylinder. Pipe 60 defines a ram activation path for water from the pump to drive the piston 56 in a downward direction (in FIG. 4). Pipe 62 defines a ram deactivation path for water from the pump to drive the piston 56 in an upward direction. The piston 56 is connected to the capping pipe 32 to drive it and the upwardly spring biased moveable probe 34 and normally closed valve 43 into the open end of the wellhead pipe 20 as previously described for the first embodiment of the invention.

At the start of an effort to extinguish a wellhead fire using the second embodiment of the present invention, ballast fluid tanks 50 are empty and rotatable yoke 52 is in its horizontal position so that ram 46 and the yoke 52 are separated as much as possible from the flame front as the ballast cart 44 is remotely maneuvered into a proper position. As shown in FIGS. 5A and B, this horizontal position is maintained until cart 44 is moved into the proper position for probe 34 insertion into the wellhead pipe 20. Such positioning may be achieved with the x-ray and optical triangulation approaches discussed earlier. Such insertion will occur when rotatable yoke 52 is actuated and shifted to its vertical position. There, probe 34 will be placed directly over the wellhead pipe 20. As with the first embodiment, a knowledge of such positioning is facilitated by the use of one or more sensing devices attached to the end of the probe and by ballast cart mounted sources and detectors.

When this "proper" position is reached, the ballast tanks 50 are filled with a fluid like water and the weight of the fluid causes the wheel supporting spring assemblies 49 to compress and the cart to bear directly on the ground. Alternatively, hydraulic cylinders could raise and lower the wheel/tractors. Such lowering of the cart serves to anchor the assembly firmly. Then, yoke 52 is rotated to its vertical position shown in FIGS. 6A and B, and ram 46 is actuated to drive capping pipe 32 and probe 34 into and seal the wellhead pipe 20.

Once the wellhead pipe is sealed by the capping pipe, mud is forced into the wellhead via a flexible hose 64 and mud valve 66 connected to a side of the capping pipe to "kill" the well fire as previously described (see FIG. 4).

The force generated by ram 46, in conjunction with the weight of the water in tanks 50, provide a sufficient reactive force for the capping pipe 32 and probe 34 to penetrate the wellhead pipe 20. If, for some reason, the capping pipe 32 does not fully penetrate the wellhead pipe 20, the operator can control the piston to rotate the capping pipe so as to "work" it into a correct sealing position within the wellhead pipe.

Once this is done, the well can be "killed" and repairs effectuated as described above. After the well has been capped and the fire extinguished, the fluid can be pumped out of the tanks 50 for reuse in subsequent operation. This, in turn, allows the springs to raise the tanks and reengage wheels 48 for easy removal of the system.

Thus there has been described a new and improved method and apparatus for effectively dealing with damaged oil wells which may be on fire. It is to be understood that the above described embodiments are merely illustrative of some of the many specific embodiments which represent applications of the principles of the present invention. Clearly, numerous other arrangements can be readily devised by those skilled in the art without departing from the scope of the invention as defined in the appended claims, and all of these embodiments are considered to be embraced therein.

I claim:

1. A free standing oil well fire capper and snuffer apparatus for cutting off oil/gas flow from a wellhead in response to upward geologic and gas pressure forces without requiring attachment to a wellhead pipe from which a flame front is emanating and for extinguishing an oil wellhead fire, the apparatus comprising:

a capper/snuffer comprising capper means capable of entering the wellhead pipe and for sealing the wellhead pipe, fluid ballast and pressure exerting means for (i) fluid ballasting the capper means over the wellhead pipe to overcome the upward geologic and gas pressure forces and (ii) driving the capper means into the wellhead pipe, and plugging means for stopping the oil/gas flow from the wellhead and for extinguishing said fire; and mobile means for moving the capper means and the fluid ballast and the pressure exerting means above the wellhead.

2. The apparatus of claim 1 wherein the fluid ballast and pressure exerting means comprises a fluid filled tank for bearing down upon the capper means when the capper means is positioned directly over the wellhead.

3. The apparatus of claim 2 wherein the capper means further comprises means for diverting the flame front away from the wellhead as the capper means enters and penetrates the wellhead pipe.

4. The apparatus of claim 3 wherein the means for diverting the flame front comprises:

a sealing skirt for axially receiving and surrounding the wellhead and for engaging ground around the wellhead to limit air in the oil/gas flow, and a flame diverter including a hollow base extending upward from the skirt with flame diverting tubes open to the base and extending outwardly therefrom to divert the flame front from the wellhead.

5. The apparatus of claim 2 further including means for cooling the capper means with fluid from the tank.

6. The apparatus of claim 1 wherein the fluid ballast and pressure exerting means comprises a fluid ballast platform supporting a hydraulic ram for bearing down upon the capper means when the capper means is positioned directly over the wellhead.

7. The apparatus of claim 6 wherein the hydraulic ram is mounted on a yoke rotatably attached to the mobile means for (1) supporting the ram in a horizontal position spaced from the wellhead and the flame front as the mobile means is positioned adjacent the wellhead and (2) rotating the ram into a vertical position with the capper means directly over the wellhead pipe to enter the wellhead pipe upon activation of the ram.

8. The apparatus of claim 7 wherein the capper means further comprises:

an axially extending capping pipe having an open end for fitting into the wellhead pipe, and an axially moveable probe extending from the capping pipe and carrying a valve normally closing the open end of the capping pipe as the capping pipe is introduced into the wellhead pipe by activation of the plugging means.

9. The apparatus of claim 8 wherein the plugging means comprises mud pumped through the capping pipe into the capper means to axially move the probe and open the valve, whereby the mud enters the wellhead pipe to "kill" and snuff the fire.

10. The apparatus of claim 7 wherein the mobile means further comprises at least one fluid-fillable tank, which when filled causes said mobile means to be anchored in position while the ram is activated.

11. The apparatus of claim 1 wherein the capper means further comprises:

an axially extending capping pipe having an open end for fitting into the wellhead pipe, and an axially moveable probed extending from the capping pipe and carrying a valve normally closing the open end of the capping pipe as the capping pipe is introduced into the wellhead pipe by activation of the plugging means.

12. The apparatus of claim 11 wherein the plugging means comprises mud pumped through the capping pipe into the capper means to axially move the probe and open the valve, whereby the mud enters the wellhead pipe to "kill" and snuff the fire.

13. The apparatus of claim 1 wherein the plugging means comprises mud pumped through the capper means into the wellhead pipe.

14. A capper/snuffer for use in extinguishing an oil wellhead fire by plugging a wellhead pipe from which oil, gas, and a fire flame front are emanating/comprising:

capper means for entering and sealing the wellhead pipe, fluid ballast and pressure exerting means for (i) fluid ballasting the capper means over the wellhead pipe against the oil and the gas emanating from the wellhead pipe and (ii) driving the capper means into the wellhead pipe, and plugging means for stopping oil and gas flow from the wellhead pipe and for extinguishing the fire.

15. The capper/snuffer of claim 14 wherein the fluid ballast and pressure exerting means comprises a fluid filled tank for bearing down upon the capper means when the capper means is positioned directly over the wellhead pipe.

16. The capper/snuffer of claim 15 wherein the capper means further comprises means for diverting the fire flame front away from the wellhead pipe as the capper means enters the penetrates the wellhead pipe.

17. The capper/snuffer of claim 16 wherein the means for diverting the flame front comprises:

a sealing skirt for axially receiving and surrounding the wellhead pipe and for engaging ground around the wellhead pipe to limit air in the oil and gas flow, and a flame diverter including a hollow base extending upward from the skirt with flame diverting tubes open to the base and extending outwardly therefrom to divert the fire flame front from the wellhead pipe.

18. The capper/snuffer of claim 15 further including means for cooling the capper means with water from the tank.

19. The capper/snuffer of claim 14 wherein the fluid ballast and pressure exerting means comprises a hydraulic ram supported by a fluid ballast platform for bearing down upon the capper means when the capper means is positioned directly over the wellhead pipe.

20. The capper/snuffer of claim 19 wherein the hydraulic ram is mounted on a yoke for (1) supporting the ram in a horizontal position spaced from the wellhead pipe and the flame front and (2) rotating the ram into a vertical position with the capper means directly over the wellhead pipe to enter the wellhead pipe upon activation of the ram.

21. The capper/snuffer of claim 20 wherein the capper means further comprises:

an axially extending capping pipe having an open end for fitting into the wellhead pipe, and an axially moveable probe extending from the capping pipe and carrying a valve normally closing the open end of the capping pipe as the capping pipe is introduced into the wellhead pipe by activation of the ram.

22. The capper/snuffer of claim 21 wherein the plugging means comprises mud pumped through the capping pipe into the capper means to axially move the probe and open the valve, whereby the mud enters the wellhead pipe to "kill" the fire.

23. The apparatus of claim 14 wherein the capper means further comprises:

an axially extending capping pipe having an open end for fitting into the wellhead pipe, and an axially moveable probe extending from the capping pipe and carrying a valve normally closing the open end of the capping pipe as the capping pipe is introduced into the wellhead pipe by activation of the plugging means.

24. The capper/snuffer of claim 23 wherein the plugging means comprises mud pumped through the capping pipe into the capper means to axially move the probe and open the valve, whereby the mud enters the wellhead pipe to "kill" and snuff the fire.

25. The capper/snuffer of claim 14 wherein the plugging means comprises mud pumped through the capper means into the wellhead pipe.

26. A method for extinguishing an oil wellhead fire comprising the steps of:

(a) centering and fluid ballasting a capper over an oil wellhead pipe from which gas, oil, and flame front are emanating;

(b) forcibly inserting the capper into the wellhead pipe to seal the wellhead pipe; and (c) introducing mud through the capper into the wellhead pipe to "kill" the fire.

27. The method of claim 26 wherein step (b) further comprises diverting the flame front from the wellhead pipe as the capper is inserted into the wellhead pipe.

28. The method of claim 27 wherein the diverting of the flame front in step (b) further comprises lowering a sealing skirt and a flame diverter onto said wellhead so as to cause the flame front to be directed away from the capper as the capper is forced into the wellhead pipe.

29. The method of claim 28 wherein steps (a) and (b) further comprises filling a tank connected to the capper with a sufficient weight of fluid to ballast the capper against the gas and the oil emanating from the wellhead pipe and to cause the capper to move downward into and seal the wellhead pipe.

30. The method of claim 26 wherein step (b) comprises actuating a hydraulic ram connected to the capper to cause the capper to enter the wellhead pipe.

* * * * *

UNITED STATES PATENT AND TRADEMARK OFFICE

CERTIFICATE OF CORRECTION

PATENT NO. : 5,199,499

DATED : April 6, 1993

INVENTOR(S) : Butler

It is certified that error appears in the above-indentified patent and that said Letters Patent is hereby corrected as shown below:

Column 7, line 16, claim 1, delete "the".

Col. 8, line 20, claim 14, change "emanating/comprising:" to --emanating comprising:--. Column 8, line 38, claim 16, after "enters", change "the" to --and--.

Signed and Sealed this

Eighteenth Day of January, 1994

*Attest:*

Bruce Lehman

BRUCE LEHMAN

*Attesting Officer*

*Commissioner of Patents and Trademarks*